US008316914B2

(12) United States Patent
Bell et al.

(10) Patent No.: US 8,316,914 B2
(45) Date of Patent: Nov. 27, 2012

(54) MOVABLE PARTITIONS, HEADER ASSEMBLIES FOR MOVABLE PARTITIONS, AND METHODS OF FORMING HEADER ASSEMBLIES FOR MOVABLE PARTITIONS

(75) Inventors: Craig Bell, South Jordan, UT (US); Tracy M. Knight, Kearns, UT (US); Jaren R. Dickenson, Kearns, UT (US)

(73) Assignee: Won-Door Corporation, Salt Lake City, UT (US)

( * ) Notice: Subject to any disclaimer, the term of this patent is extended or adjusted under 35 U.S.C. 154(b) by 210 days.

(21) Appl. No.: 12/510,382

(22) Filed: Jul. 28, 2009

(65) Prior Publication Data

US 2011/0024061 A1 Feb. 3, 2011

(51) Int. Cl.
*E05D 15/26* (2006.01)

(52) U.S. Cl. ..... 160/199; 160/126; 16/95 R

(58) Field of Classification Search ..... 160/199, 160/206, 126; 16/87.4 R, 94 R, 94 D, 95 R, 16/95 D, 96 R, 96 D; 52/39
See application file for complete search history.

(56) References Cited

U.S. PATENT DOCUMENTS

| | | | | | |
|---|---|---|---|---|---|
| 3,042,960 | A | * | 7/1962 | Spork | 16/105 |
| 3,191,214 | A | * | 6/1965 | Protzman | 16/87 R |
| 3,509,934 | A | * | 5/1970 | Smart | 160/84.08 |
| 3,708,927 | A | * | 1/1973 | Cohen | 52/39 |
| 3,715,776 | A | * | 2/1973 | Tanaka | 16/94 D |
| 3,783,930 | A | * | 1/1974 | Williams | 160/199 |
| 3,878,583 | A | * | 4/1975 | Smart | 16/95 R |
| 3,998,020 | A | * | 12/1976 | Kuhr et al. | 52/506.07 |
| 4,011,696 | A | * | 3/1977 | Klein | 52/39 |
| 4,023,235 | A | * | 5/1977 | Cohen et al. | 16/94 D |
| 4,281,481 | A | | 8/1981 | Wendt | |
| 4,294,054 | A | * | 10/1981 | Kuhr | 52/506.07 |
| 4,549,375 | A | * | 10/1985 | Nassof | 52/39 |
| 4,674,248 | A | | 6/1987 | Hall | |
| 5,411,072 | A | | 5/1995 | Starck et al. | |
| 6,615,894 | B1 | | 9/2003 | McKeon | |
| 2008/0105387 | A1 | * | 5/2008 | Coleman et al. | 160/194 |

FOREIGN PATENT DOCUMENTS

EP 0 725 191 A1 8/1996

(Continued)

OTHER PUBLICATIONS

International Search Report of the ISA/KR, International Application No. PCT/US2010/043319, Apr. 22, 2011, three (3) pages.

(Continued)

*Primary Examiner* — David Purol
(74) *Attorney, Agent, or Firm* — TraskBritt

(57) ABSTRACT

Movable partitions and movable partition system include a header assembly and a movable partition. The header assembly may comprise an elongated overhead track including a first channel, a second channel, and a central channel between the first and second channels. A plurality of support bracket attachment features may be included with at least one support bracket attachment feature on each of an outer surface of the first channel and an outer surface of the second channel. A support bracket may be coupled to each of the support bracket attachment features. The movable partition may comprise a plurality of panels connected to one another with hinge-like member and may be suspended from the overhead track. Embodiments of overhead tracks and methods of forming header assemblies are also disclosed.

28 Claims, 5 Drawing Sheets

FOREIGN PATENT DOCUMENTS

| | | | |
|---|---|---|---|
| JP | 07-197730 | A | 8/1995 |
| JP | 2007-063772 | A | 3/2007 |
| KR | 20-1994-0004244 | Y1 | 6/1994 |
| WO | 2008-058029 | A1 | 5/2008 |

OTHER PUBLICATIONS

Written Opinion of the International Searching Authority, International Application No. PCT/US2010/043319, Apr. 22, 2011, three (3) pages.

* cited by examiner

MOVABLE PARTITIONS, HEADER ASSEMBLIES FOR MOVABLE PARTITIONS, AND METHODS OF FORMING HEADER ASSEMBLIES FOR MOVABLE PARTITIONS

TECHNICAL FIELD

Embodiments of the present invention are directed to header assemblies for movable partitions, movable partition assemblies including header assemblies, and methods of forming and installing movable partitions and header assemblies.

BACKGROUND

Movable partitions are utilized in numerous situations and environments for a variety of purposes. Such partitions may include, for example, a movable partition comprising foldable or collapsible doors configured to enclose or subdivide a room or other area. Often such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof. Movable partitions may also be used to provide a security barrier, a fire barrier, or both a security and a fire barrier. In such a case, the partition barrier may be configured to automatically close upon the occurrence of a predetermined event such as the actuation of an associated alarm.

One or more accordion or similar folding-type partitions may be used to enclose or subdivide a room, as a noise control, a security barrier, a fire barrier, or both a security and a fire barrier wherein each partition is formed with a plurality of panels connected to one another with hinges. The hinged connection of the panels allows the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other specified reason, the partition may be extended along an overhead track, which is often located above the door in a header assembly, until the partition extends a desired distance across the room.

FIG. 1 illustrates an example of a conventional header assembly 110. The header assembly 110 is configured for a use as a fire door and is provided in a header recess 120 formed between two fire rated walls 130 which include an opening for the movable partition (not shown). The header assembly 110 includes rods 140 extending from a structural support 150 provided above the two fire rated walls 130. The rods 140 extend from the structural support 150 to a location proximate to an overhead track 160 provided for the movable partition. One or more layers of plywood 170 are attached to the rods 140 extending from the support structure 150. The layers of plywood 170 extend longitudinally along the length of the movable partition and the overhead track 160. The layers of plywood 170 also extend laterally across the header recess 120 to the two fire rated walls 130.

One or more layers of gypsum board 180 are provided between the overhead track 160 and the layers of plywood 170. The layers of gypsum board 180 also extend longitudinally along the length of the movable partition and the overhead track 160 and extend laterally across the header recess 120 to the two fire rated walls 130. Some of the layers of gypsum board 180 extend only partially across the header recess 120 in a lateral direction in order to provide a pocket for the overhead track 160. That is, some layers of gypsum board 180 extend longitudinally along a lateral side of the overhead track 160 and extend laterally between a lateral side of the overhead track 160 and one of the two fire rated walls 130.

The layers of plywood 170 and gypsum board 180 are typically custom fitted onsite during installation of the movable partition. Because some of the measurements needed for custom fitting the layers of plywood 170 and gypsum board 180 are only obtained after other portions of a door assembly are installed, the installer often must leave the installation site to obtain fitted plywood 170 and gypsum board 180 for installation at another time.

BRIEF SUMMARY

Various embodiments of the present disclosure comprise movable partition systems and header assemblies for movable partition systems, which are more easily and efficiently installed and significantly reduce the number of required fasteners.

In one or more embodiments the present disclosure, a movable partition system may comprise a header assembly and a movable partition. The header assembly may comprise an elongated overhead track including a first channel, a second channel, and a central channel between the first and second channels. A plurality of support bracket attachment features may be included with at least one support bracket attachment feature on each of an outer surface of the first channel and an outer surface of the second channel. A track support bracket may be coupled to each of the support bracket attachment features. The movable partition may comprise a plurality of panels connected to one another with hinge-like member and may be suspended from the overhead track.

An overhead track of the present disclosure may comprise a central channel configured to receive at least one roller for a foldable partition therein. A first channel may be coupled to the central channel on a side thereof, and a second channel may be coupled to the central channel on another side opposite the first channel. A support bracket attachment feature may be included on an outer surface of the first channel and an outer surface of the second channel in some embodiments. In some embodiments, a drive member channel configured to receive a drive member therein may be included inside the central channel.

A header assembly for a movable partition according to various embodiments of the disclosure may comprise an overhead track comprising a first channel, a second channel, a central channel between the first channel and the second channel. A support bracket attachment feature may be included on each of an outer surface of the first channel and an outer surface of the second channel and a track support bracket may be coupled to each of the support bracket attachment features.

Other embodiments comprise methods for forming header assemblies for one or more embodiments of movable partitions. According to some embodiments, such methods may comprise positioning an overhead track within a longitudinally extending space between a first wall and a second wall. A track support bracket and a soffit may be attached to the overhead track.

DETAILED DESCRIPTION

Illustrations presented herein are not meant to be actual views of any particular partition or header assembly, but are merely idealized representations that are employed to describe embodiments of the present invention. Additionally, elements common between figures may retain the same numerical designation.

Figure 2:
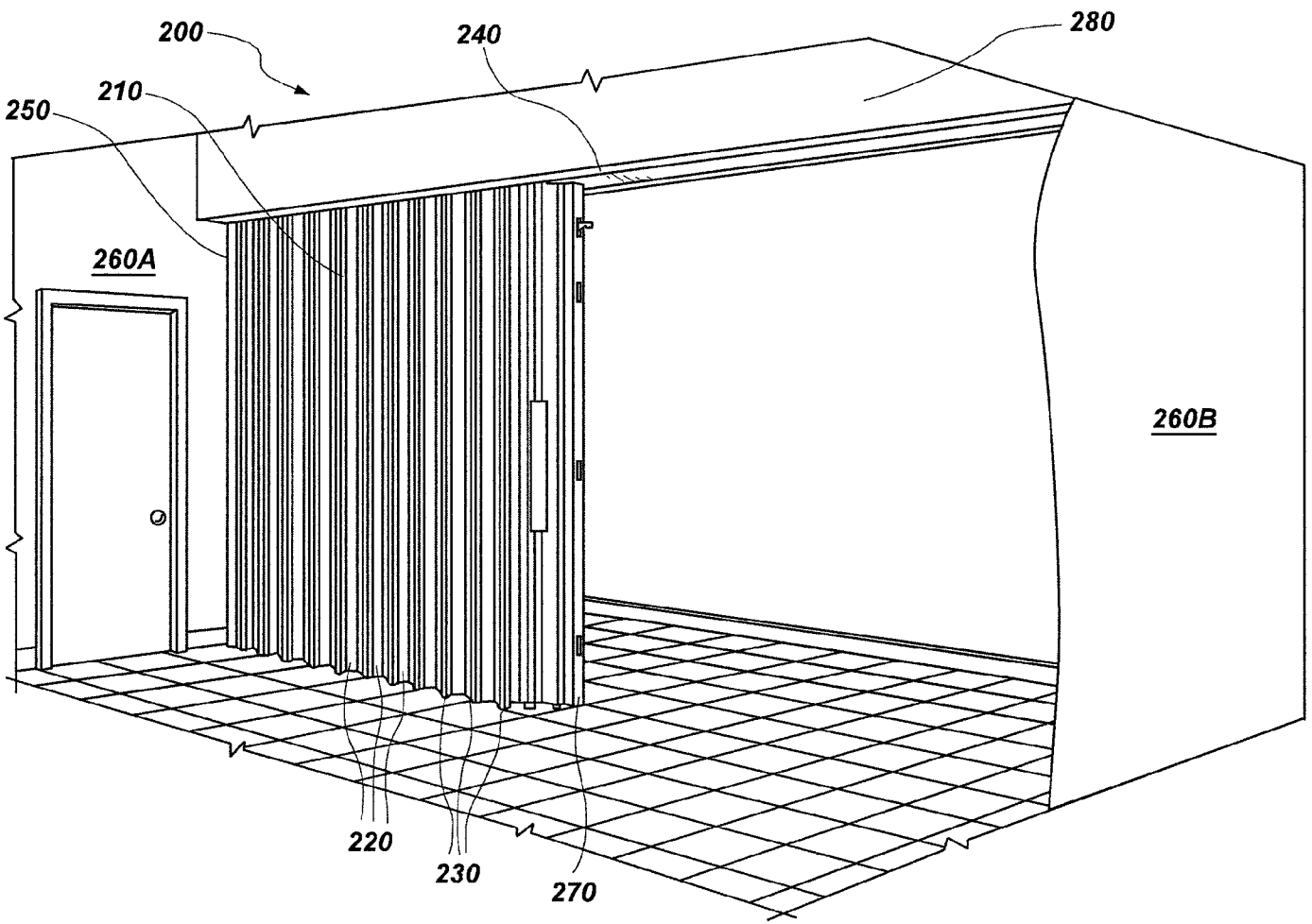
FIG. 2 is a perspective view of an embodiment of a movable partition system of the present disclosure.

Referring to FIG. 2, a system 200 is shown, which may also be referred to as a movable partition system 200, including a movable partition 210 in the form of an accordion-type door. The movable partition 210 may be used as a barrier (e.g., sound barrier, security barrier, fire barrier, etc.). As used herein, the term "sound barrier" means any material, structure, or element configured to provide a barrier to sound waves or configured to retard or resist the travel of sound waves between two or more areas. The term "fire barrier" or "fire resistant" means any material, structure, or element configured to provide a barrier to fire, smoke, and/or heat or configured to retard or resist the deleterious effects of fire, smoke, and/or heat for a certain period of time. In other embodiments, the movable partition 210 may be used, for example, to subdivide a relatively larger space into relatively smaller spaces (e.g., rooms or areas). The movable partition 210 may be formed with a plurality of panels 220 that are connected to one another with hinges or other hinge-like members 230 to form a pleated (i.e., plicated) structure. The movable partition 210 is engaged with (e.g., suspended from) an overhead track 240 along which the movable partition 210 moves as the movable partition 210 is expanded (i.e., closed) and retracted (i.e., opened). The hinged connection of the panels 220 allows the movable partition 210 to be compactly stored in a pocket 250 formed in a wall 260A of a building when in a retracted or folded state.

To deploy the movable partition 210 to an extended position, the movable partition 210 is moved along the overhead track 240. A leading edge of the movable partition 210 may include a lead post 270 configured to engage with a door jamb or another post, which may be provided in a wall 260B of a building to which the movable partition 210 may extend in an extended state. While the embodiment of the movable partition 210 shown and described with reference to FIG. 2 contains a single accordion-type door, additional embodiments of the present invention may include multiple doors. For example, a partition may include two doors (e.g., accordion-type doors) configured to extend across a space and join together to partition a space.

The system 200 also includes a header structure 280. The header structure 280 may include a structural support member and a header assembly, as discussed in further detail below. The movable partition 210 may be suspended from and supported by the header structure 280. In other embodiments, the movable partition 210 may be supported by the floor below the movable partition 210, and the header structure 280 may simply serve as a guide for the movable partition 210. While the embodiment of the header structure 280 shown and described with reference to FIG. 2 protrudes into the space where the movable partition 210 is located, the header structure 280 may be partially or entirely located in an overhead structure in additional embodiments. For example, the header structure 280 may not protrude into the space where the movable partition 210 is located, but rather, may be located in an overhead structure such that the overhead track 240 is mounted generally flush with the ceiling of the space.

Figure 3:
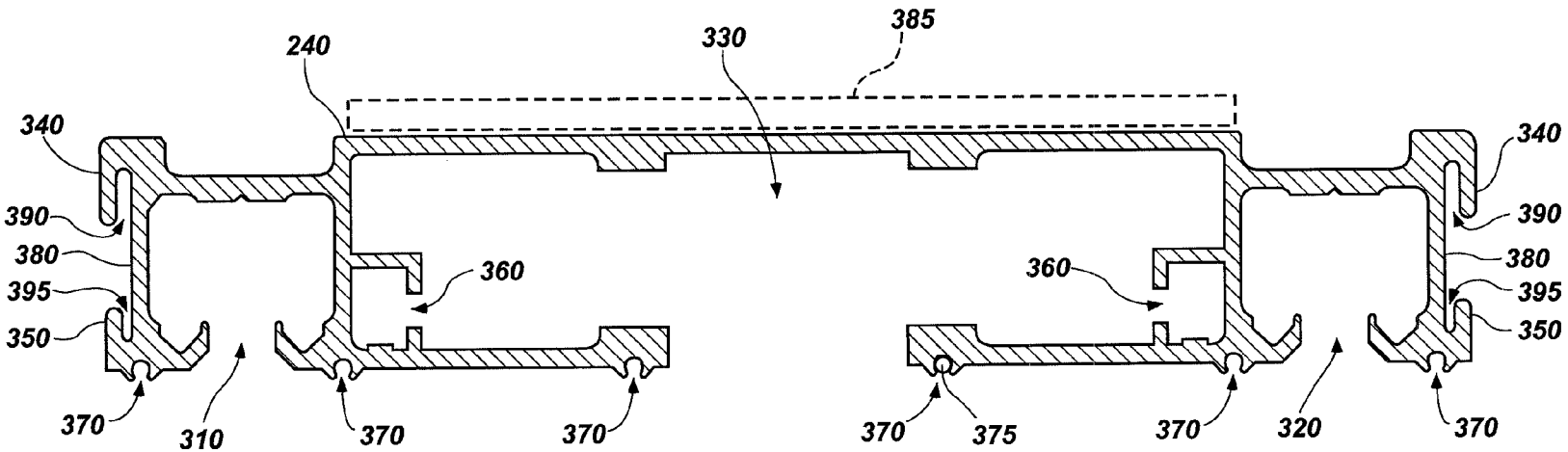
FIG. 3 is a cross-sectional view of an overhead track according to at least one embodiment of a movable partition system of the present disclosure.

The header structure 280 of the system 200 may include a header recess 420 (FIG. 4), described in more detail herein below. A header assembly (e.g., 410 in FIGS. 4 and 5) may be located at least partially within the header recess 420. In some embodiments, the header assembly for a movable partition 210 may include an overhead track 240. Referring to FIG. 3, the overhead track 240 may include, for example, a first channel 310 and a second channel 320. The first channel 310 may be configured for receipt of slide mechanisms or rollers that may be attached to individual panels 220 associated with a first side of a movable partition 210 (FIG. 2), while a second channel 320 may be configured for receipt of similar slide mechanisms or rollers associated with individual panels 220 associated with a second side of the movable partition 210 (FIG. 2). The overhead track 240 may further include a central channel 330 may be disposed between the first and second channels 310 and 320. The central channel 330 may be configured for receipt of one or more rollers or sliders (e.g., a trolley) therein, and may provide a raceway for a belt or chain.

According to various embodiments, the overhead track 240 may further include a support bracket attachment feature 340, a soffit attachment feature 350, a drive member channel 360, or one or more alignment grooves 370, as well as various combinations any of the foregoing.

The support bracket attachment feature 340 is located on an outer surface 380 of the first channel 310 and the second channel 320. In at least some embodiments, the support bracket attachment feature 340 may comprise a hook-shaped member that extends along the outer surface of the overhead track 240. In other words, the hook-shaped member may extend in the direction that would be into or out from the page as the overhead track 240 is oriented in FIG. 3. The hook shape of the support bracket attachment feature 340 results in a slot 390 configured to receive a portion of a corresponding track support bracket therein.

The soffit attachment feature 350 is also located on the outer surface 380 of the first channel 310 and the second channel 320 of the overhead track 240. In at least some embodiments, the soffit attachment feature 350 may also comprise a hook-shaped member extending along the outer surface of the overhead track 240. Like the hook shape of the support bracket attachment feature 340, the hook shape of the soffit attachment feature 350 forms a slot 395 configured to receive a portion of a soffit therein.

The drive member channel 360 may be located within a portion of the central channel 330 and may be sized and configured to receive a drive member therein. By way of example and not limitation, the drive member channel 360 may be sized and configured to receive the chain of a chain and sprocket drive member, or the rack of a rack and pinion drive member.

The one or more alignment grooves 370 comprise a groove configured to receive and retain a rod 375 therein. In at least some embodiments of the system 200, the overhead track 240 may comprise a plurality of overhead track sections coupled together at their longitudinal ends to form an elongated overhead track 240 along which the movable partition 210 is configured to move. The one or more alignment grooves 370 for each overhead track section are located in substantially the same position. When the plurality of overhead track sections are coupled together, a rod 375 may be positioned in each of the one or more alignment grooves 370 of the two overhead track sections being coupled to aid in vertically and horizontally aligning the track sections, and all of their corresponding features. Although the alignment grooves 370 are illustrated on the outer surface 380 of the overhead track 240, one or more alignment grooves 370 may be positioned on the inner surface (e.g., in the first channel 310, the second channel 320 and/or the central channel 330) of a portion of the overhead track 240, as well as combinations thereof.

To secure sections of the overhead track 240 that are coupled together, a rigid support plate 385, shown in broken lines, may be positioned over the joint where the sections of the overhead track 240 are joined. The support plate 385 is then attached to each of the overhead track sections with one or more fasteners, such as screws or bolts.

The overhead track 240 may comprise any suitably rigid material. For example, the overhead track 240 may comprise a metal or metal alloy, a plastic, a composite or a ceramic material. In some embodiments, the overhead track 240, including the first channel 310, the second channel 320, the central channel 330 and any one or more of the support bracket attachment feature 340, the soffit attachment feature 350, the drive member channel 360 and one or more alignment grooves 370, may comprise an integral piece. Such an integral piece may be formed by, for example, extruding the overhead track 240 by conventional extrusion techniques generally known to those of ordinary skill in the art.

Figure 1:
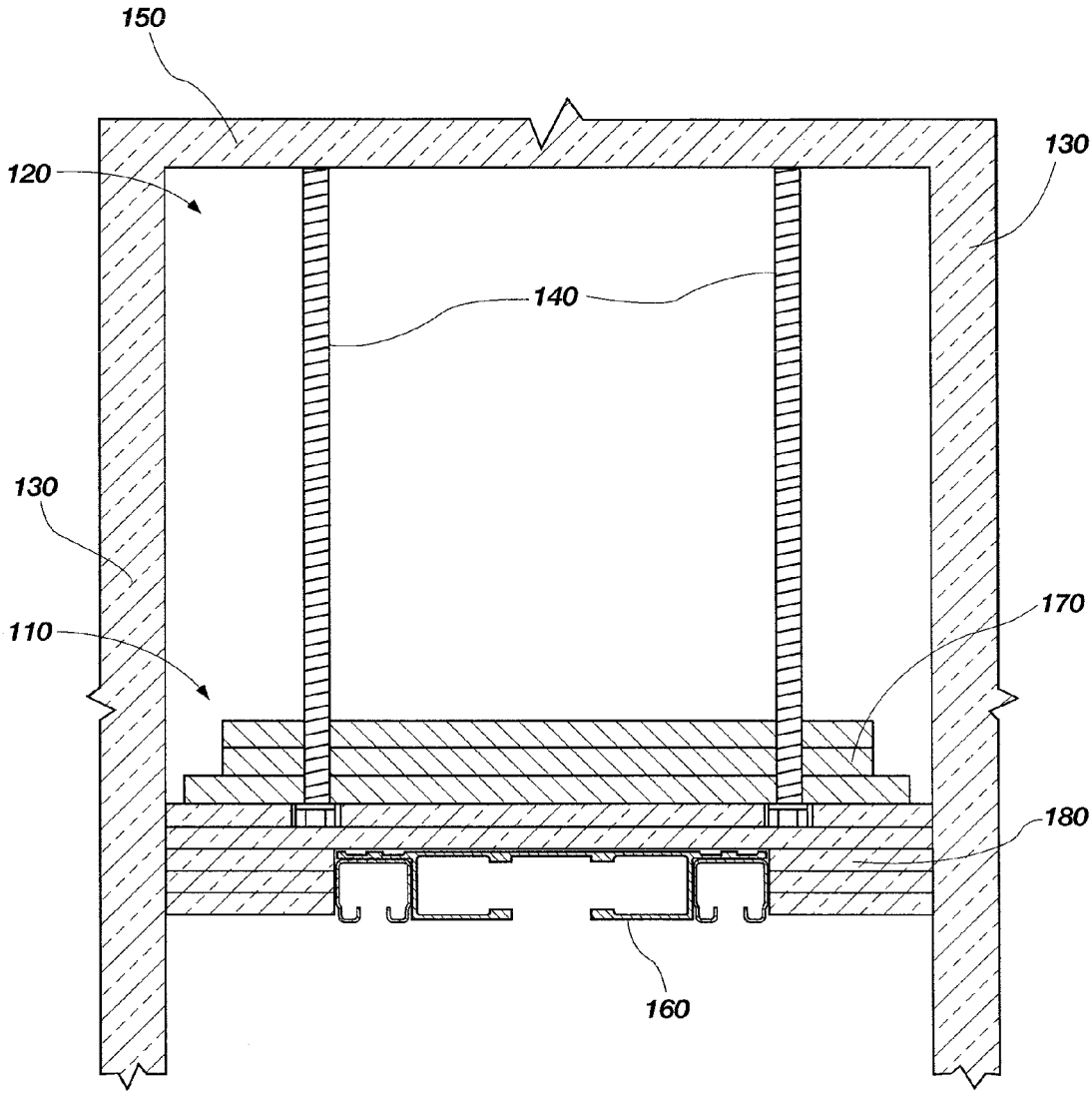
FIG. 1 (PRIOR ART)
FIG. 1 shows a partial cross-sectional view of a conventional header assembly for a movable partition.
Figure 4:
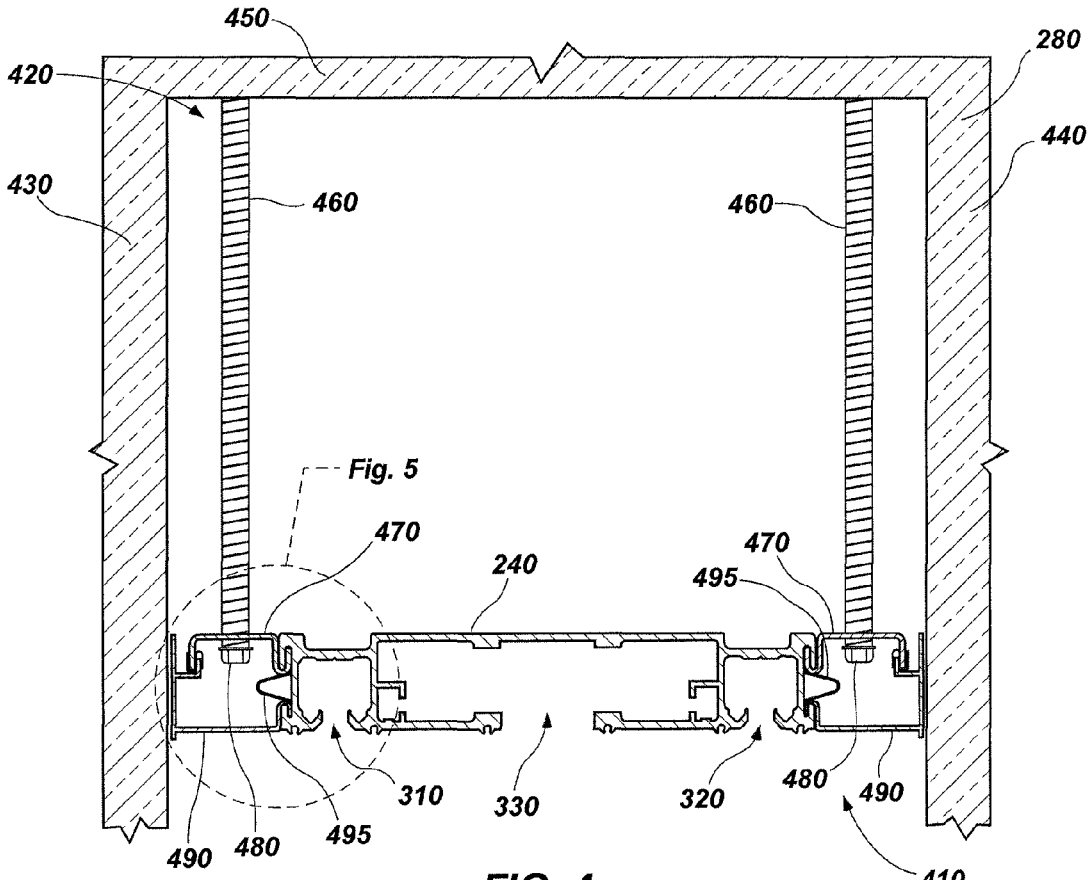
FIG. 4 shows a partial cross-sectional view of a header structure including an embodiment of a header assembly of the movable partition system shown in FIG. 2.

Referring to FIG. 4, the header structure 280 of the system 200 (FIG. 2) is shown in a partial cross-sectional view. As shown in FIG. 4, a header assembly 410 may be located at least partially within a header recess 420 in the header structure 280. The header recess 420 may be similar to the header recess 120 shown in FIG. 1 and may be provided between a first wall 430, a second wall 440, and an overhead support member 450. It is noted that while the embodiment of FIG. 4 illustrates the header assembly 410 located within the header recess 420 of the header structure 280, the current invention is not so limited. The header assembly 410 may not be located in the header recess 420, but rather, may be located in any suitable location or may be mounted directly to an overhead support structure.

The header assembly 410 comprises an overhead track 240 including the first channel 310, the second channel 320 and the central channel 330. The overhead track 240 may be attached to the overhead support member 450 by fastener elements such as rods 460. One end of each of the rods 460 may be attached to the overhead support member 450. Each rod 460 may comprise a threaded rod that extends through the overhead support member 450, and a nut may be threaded onto the end of the overhead support member 450 on a side thereof opposite the overhead track 240 to retain the rod 460 in position relative to the overhead support member 450. The overhead support member 450 may be, for example, a wood or metal beam, a truss structure, floor joists, etc.

The overhead track 240 is coupled to (directly or indirectly) and suspended from the rods 460. As shown in FIG. 4, the overhead track 240 may be indirectly coupled to the rods 460 using track support brackets 470, described more fully below. The ends of the rods 460 opposite the overhead support member 450 may extend through a portion of the track support brackets 470, and nuts 480 may be used to retain the track support brackets 470 on the rods 460. The rods 460 may be configured so that the vertical location of the overhead track 240 may be adjusted to accommodate changes to the overhead support member 450 over time. For example, in some embodiments where the movable partition 210 (FIG. 2) is implemented as a sound barrier, a space divider, etc., the height of the overhead track 240 may be adjusted by advancing or withdrawing the nuts 480 to accommodate settling of portions of an edifice in which the movable partition 210 is implemented.

In some embodiments, the rods 460 may be threaded and may be anchored to an overhead support member 450. The rods 460 extend from the overhead support member 450 to the support brackets 470 and may be coupled thereto. The rods 460 may be coupled or fastened to the overhead support member 450 by any suitable manner such as, for example, using conventional nuts. In some embodiments, the rods 460 may be located at set distances along the overhead track 240 to attach the support brackets 470 to the overhead support member 450. For example, the rods 460 may be spaced at set intervals along the overhead track 240, each interval being spaced a set distance such as 18 inches (45.72 centimeters) apart. Further, in some embodiments, when the movable partition 210 (FIG. 2) is retracted (i.e., opened), the weight of the movable partition 210 will be concentrated in the area of the overhead track 240 located above the retracted movable partition 210 (e.g., the section of the overhead track 240 located in the pocket 250). Therefore, the rods 460 may be spaced at shorter intervals such as 12 inches (30.48 centimeters) in the area where the movable partition 210 is stored in a retracted state. It is noted that while overhead track 240 of FIG. 4 is shown suspended from the overhead support member 450 by the rods 460, the overhead track 240 may be attached, suspended, or spaced from the overhead support member 450 by any suitable manner including, but not limited to, attaching the overhead track 240 directly to the overhead support member 450.

As shown in FIG. 4, in some embodiments, the header assembly 410 may further include soffits 490 coupled to the overhead track 240. Furthermore, in some embodiments, the header assembly 410 may include retainer members 495 configured to retain the track support brackets 470 and the soffits 490 to the overhead track 240 on opposing sides of the header assembly 410.

Figure 5:
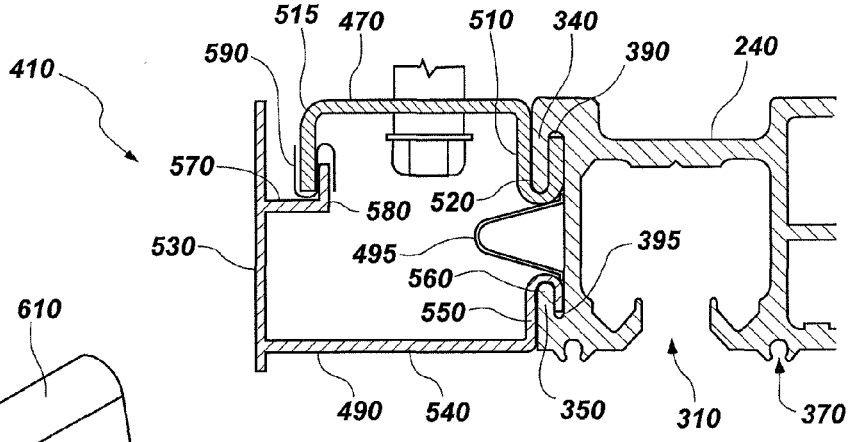
FIG. 5 is an enlarged view of a portion of the header assembly of FIG. 4.

Referring to FIG. 5, an enlarged view is shown of the left side of the header assembly 410 indicated generally by the broken-lined circle in FIG. 4. The track support brackets 470 may comprise a track attachment feature 510 configured to be coupled to the support bracket attachment feature 340 of the overhead track 240 and a soffit coupling feature 515. In some embodiments, the track attachment feature 510 may comprise a hook shape configured to receive, and be received by the hook-shaped support bracket attachment feature 340 of the overhead track 240. As shown in FIG. 5, a hook-shaped track attachment feature 510 may slide into and be received by the slot 390 of the support bracket attachment feature 340, as well as receive the hook-shaped support bracket attachment feature 340 in a slot 520 formed by the hook-shaped track attachment feature 510.

In some embodiments, the track support brackets 470 may comprise a single piece extending substantially the entire length of the overhead track 240 along each side thereof. In other embodiments, a plurality of track support brackets 470 may be employed on each side of the overhead track 240, the track support brackets 470 being evenly spaced along the length of the overhead track 240. By way of example only, each track support bracket 470 may comprise a length of between 4 in. (10.16 cm) and 12 in. (30.48 cm) and maybe spaced from each adjacent track support bracket 470 along a both sides of the overhead track 240 by about 3 in. (7.62 cm) to 12 in. (30.48 cm).

With continued reference to FIG. 5, a soffit 490 may comprise a vertical member 530 and a first extension 540 extending from the vertical member 530. The first extension includes a first attachment feature 550 configured to attach to the soffit attachment feature 350 of the overhead track 240. In some embodiments, the first attachment feature 550 may comprise a hook shape configured to receive, and be received by the hook-shaped soffit attachment feature 350 of the overhead track 240. As shown in FIG. 5, a hook-shaped first attachment feature 550 may slide into and be received by the slot 395 of the soffit attachment feature 350, and receive the hook-shaped soffit attachment feature 350 in a slot 560 formed by the hook-shaped first attachment feature 550.

The soffit 490 may further include a second extension 570 extending from the vertical member 530 and comprising a second attachment feature 580. The second attachment feature 580 is configured to mate with the soffit coupling feature 515 of the track support bracket 470. Mating the second attachment feature 580 of the soffit 490 and the soffit coupling feature 515 of the track support bracket 470 may aid in aligning the header assembly 410 as well as reducing or inhibiting lateral displacement of the header assembly 410 or its various components (e.g., the overhead track 240). In some embodiments, a clip 590 may be employed to fixedly join the second attachment feature 580 and the soffit coupling feature 515 together. In at least some embodiments, the clip 590 may comprise any conventional s-clip.

Figure 6:
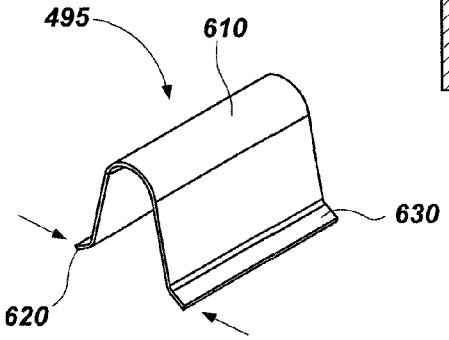
FIG. 6 shows an isometric view of a retainer member according to at least one embodiment.

As shown in FIGS. 4 and 5, retainer members 495 may be employed to retain the track support brackets 470 and the soffits 490 to the overhead track 240. FIG. 6 shows an isometric view of a retainer member 495 according to at least one embodiment. The retainer member 495 may comprise a generally c-shaped cross-section including an arcuate central portion 610 and two ends 620, 630 spaced apart from each other. The two ends 620, 630 may be at least partially compressed toward each other in the direction of the arrows and positioned with one end 620 adjacent the track attachment feature 510 that is coupled to the support bracket attachment feature 340 and the other end 630 adjacent the first attachment feature 550 that is coupled to the soffit attachment feature 350. After the retainer member 495 is positioned as described, ends 620, 630 of the retainer member 495 may partially decompress and exert a force against the track attachment feature 510 and the first attachment feature 550 to retain them in attachment with the support bracket attachment 340 and the soffit attachment feature 350, respectively. The retainer member 495 may comprise a substantially rigid material, such as steel.

The header assembly 410 illustrated in FIGS. 4 and 5 may be especially suitable for a movable partition system implemented as a sound barrier, a space divider, etc., as opposed to a fire barrier. Accordingly, at least the soffit 490 may comprise a material that is not suitable for a fire barrier, such as PVC. As discussed above, the header assembly 410 maybe raised or lowered to accommodate changes in the height of the system and is, accordingly, not fixedly attached to the first wall 430 or the second wall 440.

Referring again to FIGS. 4 and 5, a method of forming a header assembly 410 for a movable partition 210 as shown in the embodiments described above is now discussed. Forming the header assembly 410 may include positioning an overhead track 240 within a longitudinally extending space between a first wall 430 and a second wall 440, such as the header recess 420 in the header structure 280.

A track support bracket 470 may be attached to the overhead track 240. As discussed previously, attaching the track support bracket 470 to the overhead track 240 may include attaching a track attachment feature 510 of the track support bracket 470 to a support bracket attachment feature 340 of the overhead track 240. In some embodiments, attaching the track attachment feature 510 to the support bracket attachment feature 340 comprises disposing a hook-shaped track attachment feature 510 into a slot 390 defined by a hook-shaped support bracket attachment feature 340.

A soffit 490 may also be attached to the overhead track 240. As discussed previously, attaching the soffit 490 to the overhead track 240 may include attaching a first attachment feature 550 of the soffit 490 to a soffit attachment feature 350 of the overhead track 240. In some embodiments attaching the first attachment feature 550 to the soffit attachment feature 350 comprises disposing a hook-shaped first attachment feature 550 into a slot 395 defined by a hook-shaped soffit attachment feature 350. The soffit 490 may also be coupled to the track support bracket 470.

As discussed previously with reference to FIG. 3, forming a header assembly 410 may further comprise coupling a plurality of overhead track sections together. Sections of the overhead track 240 may be coupled together by disposing a rod 375 into at least one alignment groove 370 in a surface of a first section of the overhead track 240 and into a corresponding alignment groove 370 in a surface of a second section of the overhead track 240.

Figure 7:
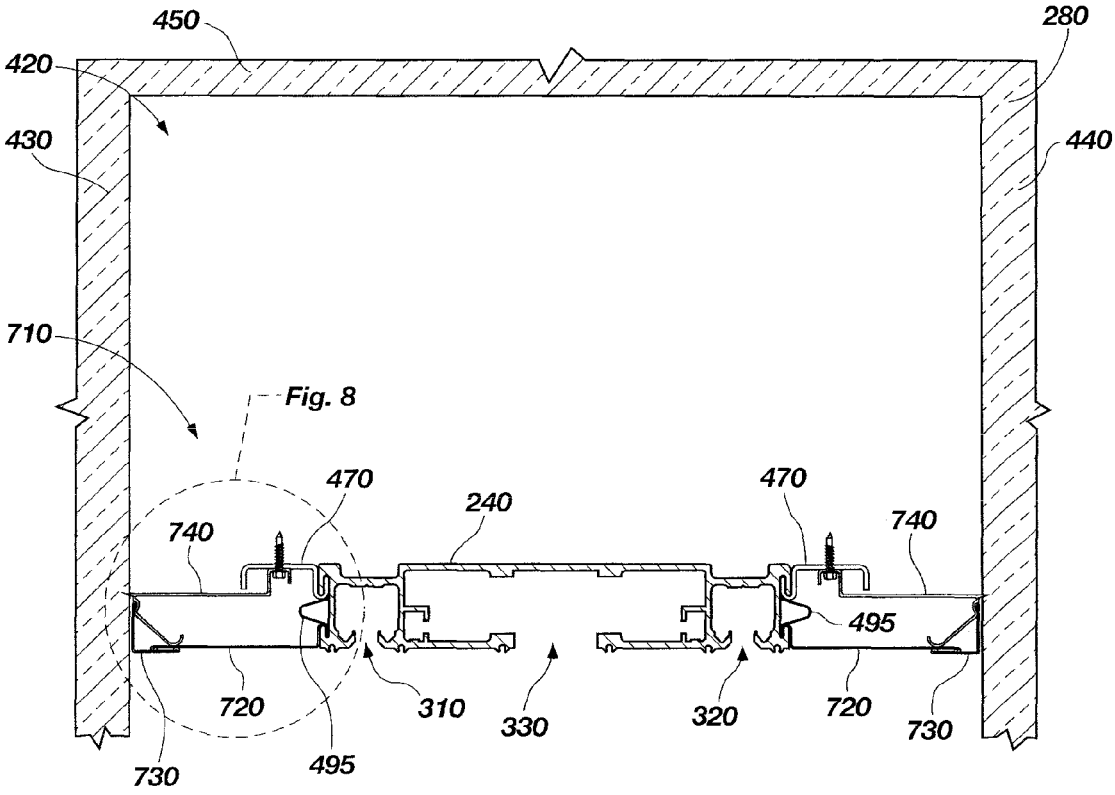
FIG. 7 shows a partial cross-sectional view of a header structure including another embodiment of a header assembly of the movable partition system shown in FIG. 2.

With reference to FIG. 7, the header structure 280 of the system 200 (FIG. 2) is shown in a partial cross-sectional view according to another embodiment. As shown in FIG. 7, a header assembly 710 may be located at least partially within a header recess 420 in the header structure 280. The header recess 420 may be similar to the header recess 120 of FIG. 1, and may be provided between a first wall 430, a second wall 440, and an overhead support member 450. It is noted that while the embodiment of FIG. 7 illustrates the header assembly 710 located within the header recess 420 of the header structure 280, the current invention is not so limited. The header assembly 710 may not be located in the header recess 420, but rather, may be located in any suitable location or may be mounted directly to an overhead support structure.

The header assembly 710 comprises an overhead track 240 including the first channel 310, the second channel 320 and the central channel 330, as described above with reference to FIG. 3. The overhead track 240 may be attached to the overhead support member 450 by fasteners, as described hereinabove. In the embodiment of FIG. 7, the header assembly 710 may further include track support brackets 470 coupled to support bracket attachment features 510 of the overhead track 240, soffit 720 coupled to a soffit attachment feature of the overhead track 240, wall trim 730, clipping members 740 coupled to the track support bracket 470 and retainer members 495.

Figure 8:
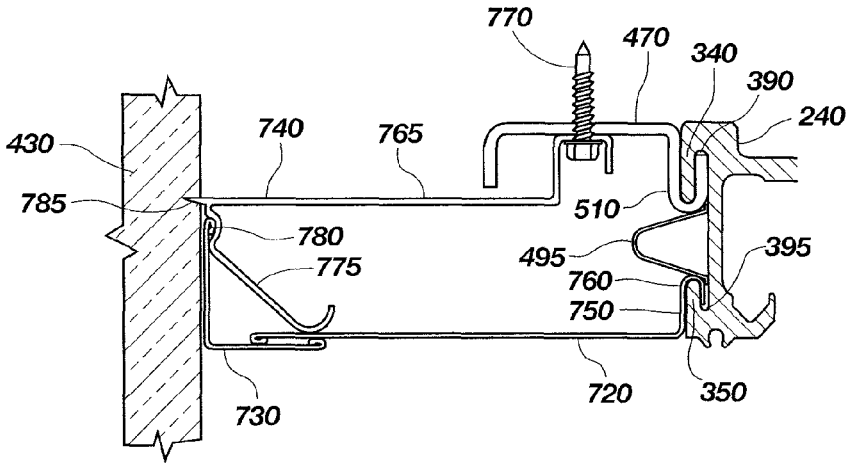
FIG. 8 is an enlarged view of a portion of the header assembly of FIG. 7.

Referring to FIG. 8, an enlarged view is shown of the left side of the header assembly 710 indicated generally by the broken-lined circle in FIG. 7. The track support brackets 470 may be substantially the same as described herein above. The track support brackets 470 may comprise a track attachment feature 510 configured to be coupled to the support bracket attachment feature 340 of the overhead track 240. In some embodiments, the track attachment feature 510 may comprise a hook shape configured to receive, and be received by the hook-shaped support bracket attachment feature 340 of the overhead track 240. As shown in FIG. 8, a hook-shaped track attachment feature 510 may slide into and be received by the slot 390 of the support bracket attachment feature 340, as well as receive the hook-shaped support bracket attachment feature 340 in a slot 520 formed by the hook-shaped track attachment feature 510.

The soffit 720 may comprise a substantially flat member comprising a first attachment feature 750 configured to attach to the soffit attachment feature 350 of the overhead track 240. In some embodiments, the first attachment feature 750 may comprise a hook shape configured to receive, and be received by the hook-shaped soffit attachment feature 350 of the overhead track 240. As shown in FIG. 8, a hook-shaped first attachment feature 750 may slide into and be received by the slot 395 of the soffit attachment feature 350, and receive the hook-shaped soffit attachment feature 350 in a slot 760 formed by the hook-shaped first attachment feature 750.

The wall trim 730 may be configured to receive and support a portion of the soffit 720 and may be fixedly attached in between bracket 740 and the first wall 430 or the second wall 440 (FIG. 7). The wall trim 730 may comprise a generally L-shaped cross-section, with one leg attached into the recess 780 and against walls 430 and 440. As stated, the wall trim 730 may receive and support a portion of the soffit 720. In at least one embodiment, the soffit 720 extends from the overhead track 240 and at least partially overlaps and lies on a portion of the wall trim 730.

The clipping member 740 is configured to be coupled to the track support bracket 470 and to retain the soffit 720 adjacent the wall trim 730. The clipping member 740 may comprise a support bracket leg 765 configured to be attached to the track support bracket 470. The support bracket leg 765 may be attached to the support bracket 470 with one or more fasteners 770, such as a screw, bolt, or the like. The clipping member 740 and the track support bracket 470 are configured so the clipping member 740 may be adjusted laterally in track support bracket 470 to account for walls 430 and 440 being unparallel prior to being fixedly fastened together. Attaching the clipping member 740 to the track support bracket 470 removes the need to take measurements, strike chalk lines, employ a laser line, or otherwise calculate and locate the proper height of the wall trim 730 to ensure alignment with the overhead track 240. The wall trim 730 may instead be aligned directly to the clipping member 740 that is already aligned with the overhead track 240 by virtue of being attached to the track support bracket 470 that is coupled with the overhead track 240.

The clipping member 740 may further include a retention leg 775 configured to extend away from the support bracket leg 765 to a location adjacent the portion of the soffit 720 that is overlapping the wall trim 730. The retention leg 775 is configured to exert a force on the soffit 720 to retain the soffit 720 adjacent the wall trim 730. The force exerted on the soffit 720 may be a result of the retention leg 775 being partially compressed toward the support bracket leg 765 when the header assembly 710 is assembled.

In order to keep the clipping member 740 from displacing upward due to the force of the partially compressed retention leg 775, the clipping member 740 may include a wall piercing feature 785. The wall piercing feature 785 is configured to be forced into and penetrate the wall 430, 440 until seated against the wall 430, 440 as the clipping member 740 is being adjusted in track support bracket 470. The fastener 770 then is fastened, coupling the track support bracket 470 to the clipping member 740 and the wall 430, 440.

Similar to the header assembly 410 in FIGS. 4 and 5, the header assembly 710 may include retainer members 495 employed to retain the track support brackets 470 and the soffits 720 to the overhead track 240. As described above with reference to FIGS. 4-6, the retainer member 495 may comprise a generally c-shaped cross-section including an arcuate central portion 610 and two ends 620, 630 spaced apart from each other. The two ends 620, 630 maybe at least partially compressed toward each other in the direction of the arrows and positioned with one end 620 adjacent the track attachment feature 510 that is coupled to the support bracket attachment feature 340 and the other end 630 adjacent the first attachment feature 750 that is coupled to the soffit attachment feature 350. After the retainer member 495 is positioned as described, ends 620, 630 of the retainer member 495 may partially decompress and exert a force against the track attachment feature 510 and the first attachment feature 750 to retain them in attachment with the support bracket attachment 340 and the soffit attachment feature 350, respectively. The retainer member 495 may comprise a substantially rigid material, such as steel.

The header assembly 710 illustrated in FIGS. 7 and 8 may be especially suitable for a movable partition system implemented as a fire barrier, security barrier, etc. Accordingly, the various components of the header assembly 710 may be formed from a fire-resistant material such as steel, composite materials, or any material capable of exhibiting fire-resistant qualities over a set period of time or any material treated with a fire retardant coating.

Referring again to FIGS. 7 and 8, a method of forming a header assembly 710 for a movable partition 210 as shown in the embodiments described above is now discussed. Forming the header assembly 710 may include positioning an overhead track 240 within a longitudinally extending space between a first wall 430 and a second wall 440, such as the header recess 420 in the header structure 280.

A track support bracket 470 may be attached to the overhead track 240. As discussed previously, attaching the track support bracket 470 to the overhead track 240 may include attaching a track attachment feature 510 of the track support bracket 470 to a support bracket attachment feature 340 of the overhead track 240. In some embodiments, attaching the track attachment feature 510 to the support bracket attachment feature 340 comprises disposing a hook-shaped track attachment feature 510 into a slot 390 defined by a hook-shaped support bracket attachment feature 340.

A soffit 720 may also be attached to the overhead track 240. As discussed previously, attaching the soffit 720 to the overhead track 240 may include attaching a first attachment feature 750 of the soffit 720 to a soffit attachment feature 350 of the overhead track 240. In some embodiments attaching the first attachment feature 750 to the soffit attachment feature 350 comprises disposing a hook-shaped first attachment feature 750 into a slot 395 defined by a hook-shaped soffit attachment feature 350.

A wall trim 730 is attached in between bracket 740 and the first wall 430 or the second wall 440 and a portion of the soffit 720 is positioned over a portion of the wall trim 730. The method further includes retaining the soffit 720 in contact with the wall trim 730 with a clipping member 740 coupled to the track support bracket 470 and the wall 430, 440.

As discussed previously with reference to FIG. 3, forming a header assembly 710 may further comprise coupling a plurality of overhead track sections together. Sections of the overhead track 240 may be coupled together by disposing a rod 375 into at least one alignment groove 370 in a surface of a first section of the overhead track 240 and into a corresponding alignment groove 370 in a surface of a second section of the overhead track 240.

While certain embodiments have been described and shown in the accompanying drawings, such embodiments are merely illustrative and not restrictive of the scope of the disclosure, and this disclosure is not limited to the specific constructions and arrangements shown and described, since various other additions and modifications to, and deletions from, the described embodiments will be apparent to one of ordinary skill in the art. Thus, the scope of the disclosure is only limited by the literal language, and legal equivalents, of the claims that follow.

What is claimed is:

1. An overhead track, comprising:

a central channel configured to receive at least one roller for a foldable partition and a drive member therein;

a first channel coupled to the central channel on a side thereof and configured to receive slide mechanisms or rollers attached to individual panels associated with a first side of the foldable partition;

a second channel coupled to the central channel on another side opposite the first channel and configured to receive slide mechanisms or rollers attached to individual panels associated with a second side of the foldable partition;

a first support bracket attachment feature on an outer surface of the first channel;

a second support bracket attachment feature on an outer surface of the second channel;

a first track support bracket including a first track attachment feature configured to couple with the first support bracket attachment feature, wherein at least one of the first track attachment feature and the first support bracket attachment feature comprises a first slot complementary to and configured to receive at least a portion of the other of the first track attachment feature and the first support bracket attachment feature, and wherein the first track support bracket includes a portion configured to extend horizontally between the first track attachment feature and an end of the first track support bracket opposite the first track attachment feature; and a second track support bracket including a second track attachment feature configured to couple with the second support bracket attachment feature, wherein at least one of the second track attachment feature and the second support bracket attachment feature comprises a second slot complementary to and configured to receive at least a portion of the other of the second track attachment feature and the second support bracket attachment feature, wherein the second track support bracket includes a portion configured to extend horizontally between the second track attachment feature and an end of the second track support bracket opposite the second track attachment feature, and wherein the first track support bracket and the second track support bracket are configured to vertically support the central channel, the first channel, and the second channel.

2. The overhead track of claim 1, further comprising a soffit attachment feature on the outer surface of the first channel and the outer surface of the second channel.

3. The overhead track of claim 1, further comprising at least one drive member channel positioned inside the central channel and configured to receive the drive member therein.

4. The overhead track of claim 3, wherein the at least one drive member channel is configured to receive a drive member configured as one of a rack or a chain.

5. The overhead track of claim 1, further comprising at least one alignment groove formed in a surface of at least one of the central channel, the first channel and the second channel.

6. An overhead track, comprising:

a central channel configured to receive at least one roller for a foldable partition therein;

a first channel coupled to the central channel on a side thereof;

a second channel coupled to the central channel on another side opposite the first channel; and a drive member channel inside the central channel and configured to receive a drive member therein, wherein the drive member channel is defined by sidewalls configured to cover at least three sides of a drive member when a drive member is received therein.

7. A header assembly for a movable partition comprising:

an overhead track comprising a first channel, a second channel, a central channel between the first channel and the second channel, a support bracket attachment feature on each of an outer surface of the first channel and an outer surface of the second channel, and a soffit attachment feature on each of the outer surface of the first channel and the outer surface of the second channel;

a track support bracket coupled to each of the support bracket attachment features, wherein each of the track support brackets includes a central portion configured to couple with a fastener configured to vertically support the overhead track, and wherein each of the track support brackets further includes a soffit coupling feature opposite a side of the track support bracket coupled to the support bracket attachment feature; and a soffit comprising a first attachment feature attached to each of the soffit attachment features of the overhead track and a second attachment feature configured to mate with the soffit coupling features of the track support brackets.

8. The header assembly of claim 7, wherein the support bracket attachment features comprise a hook-shaped member defining a slot, and wherein the track support brackets comprise a hook-shaped track attachment feature disposed into a slot defined by the hook-shaped member of the support bracket attachment features.

9. The header assembly of claim 7, wherein the soffit coupling feature of each of the track support brackets is configured to mate with the second attachment feature of the soffits to restrain lateral displacement of the overhead track.

10. The header assembly of claim 9, wherein the soffit coupling feature of the track support brackets is mated to the second attachment feature of the soffits with at least one clip.

11. The header assembly of claim 7, further comprising:

a wall trim attachable to an adjacent wall and configured to receive and support a portion of each soffit; and a clipping member coupled to each track support bracket and comprising a retention leg configured to exert a force on the portion of the soffit supported by the wall trim.

12. The header assembly of claim 11, wherein the clipping members comprise a wall piercing feature configured to penetrate at least partially into an adjacent wall.

13. The header assembly of claim 7, further comprising a plurality of retainer members comprising a c-shaped cross-section, each retainer member disposed with one end positioned adjacent a portion of one of the track support brackets to apply a force thereto and with another end adjacent a portion of one of the soffits to apply a force thereto.

14. A movable partition system comprising:

a header assembly, comprising:

an elongated overhead track comprising a first channel, a second channel, and a central channel between the first channel and the second channel;

a plurality of support bracket attachment features, at least one support bracket attachment feature on each of an outer surface of the first channel and an outer surface of the second channel;

a track support bracket coupled to each of the support bracket attachment features along a first side of the track support bracket, wherein the track support bracket comprises a soffit coupling feature along a second side of the track support bracket opposite the first side thereof; and a fastener element coupled to each track support bracket between the first side and the second side of the track support bracket and coupled to an overhead support member to vertically support the elongated overhead track; and a movable partition comprising a plurality of panels connected to one another with hinge-like members and suspended from the elongated overhead track.

15. The movable partition system of claim 14, wherein the header assembly is attached to at least one of an overhead support member and a plurality of walls.

16. The movable partition system of claim 14, further comprising:

a plurality of soffit attachment features, at least one soffit attachment feature on each of the outer surface of the first channel and the outer surface of the second channel; and a soffit attached to each of the soffit attachment features.

17. The movable partition system of claim 16, wherein each soffit is further mated to the support brackets coupled to each of the track support bracket attachment features.

18. The movable partition system of claim 16, further comprising:

a wall trim attached to an adjacent wall and configured to receive and support a portion of each soffit thereon; and a clipping member coupled to each track support bracket and comprising a retention leg configured to exert a force on the portion of the soffit supported by the wall trim, and a wall piercing feature penetrating at least partially into the adjacent wall.

19. A method of forming a header assembly for a movable partition, the method comprising:

positioning an overhead track within a longitudinally extending space between a first wall and a second wall;

positioning a portion of a first attachment feature on a first outer surface of the overhead track within a first slot of a first track attachment feature of a first track support bracket to attach the first track support bracket to the overhead track;

positioning a portion of a second attachment feature on a second outer surface of the overhead track opposite the first outer surface within a second slot of a second track attachment feature of a second track support bracket to attach the second track support bracket to the overhead track;

vertically supporting the overhead track with the first track support bracket and the second track support bracket from an overhead support structure; and attaching a soffit to the overhead track.

20. The method of claim 19, wherein attaching the track attachment feature of the track support bracket to the support bracket attachment feature of the overhead track comprises disposing a hook-shaped track attachment feature into a slot defined by a hook-shaped track support bracket attachment feature.

21. The method of claim 19, wherein attaching the soffit to the overhead track comprises attaching a first attachment feature of the soffit to a soffit attachment feature on at least one of the first outer surface and the second outer surface of the overhead track.

22. The method of claim 21, wherein attaching a first attachment feature of the soffit to a soffit attachment feature of the overhead track comprises disposing a hook-shaped first attachment feature into a slot defined by a hook-shaped soffit attachment feature.

23. The method of claim 19, further comprising coupling the track support bracket to the soffit.

24. The method of claim 19, further comprising:

attaching a wall trim to a wall and positioning a portion of the soffit over a portion of the wall trim; and retaining the soffit in contact with the wall trim with a clipping member coupled to the track support bracket.

25. A method of forming a header assembly for a movable partition, the method comprising:

positioning an overhead track including a drive member channel inside a central channel thereof within a longitudinally extending space between a first wall and a second wall;

attaching a track support bracket to the overhead track;

attaching a soffit to the overhead track; and disposing a retainer member having a generally c-shaped cross-section proximate the overhead track with one end of each retainer member positioned adjacent a portion of the track support bracket to apply force thereto and another end positioned adjacent a portion of the soffit to apply a force thereto.

26. The method of claim 25, further comprising positioning a drive member within the drive member channel, wherein at least three sides of a cross-section of the drive member are covered by sidewalls defining the drive member channel.

27. The header assembly of claim 10, wherein the at least one clip comprises an s-clip.

28. The overhead track of claim 1, wherein each of the first track attachment feature and the first support bracket attachment feature comprises a first slot configured to receive at least a portion of the other of the first track attachment feature and the first support bracket attachment feature, and wherein each of the second track attachment feature and the second support bracket attachment feature comprises a second slot configured to receive at least a portion of the other of the second track attachment feature and the second support bracket attachment feature.

* * * * *